US010357784B2

(12) United States Patent
Schlarb

(10) Patent No.: US 10,357,784 B2
(45) Date of Patent: Jul. 23, 2019

(54) SOLID-WALL SCROLL CENTRIFUGE WITH FRONT WALL WITH DISCHARGE OPENING HAVING A WEIR EDGE AND AN ENERGY RECOVERY DEVICE DEFINING A DISCHARGE PIPE ON THE OUTSIDE OF THE FRONT WALL AND IN FRONT OF THE DISCHARGE OPENING HAVING THE WEIR EDGE

(71) Applicant: Flottweg SE, Vilsbiburg (DE)

(72) Inventor: Manfred Schlarb, Vilsbiburg (DE)

(73) Assignee: FLOTTWEG SE (DE)

( * ) Notice: Subject to any disclaimer, the term of this patent is extended or adjusted under 35 U.S.C. 154(b) by 595 days.

(21) Appl. No.: 14/782,603

(22) PCT Filed: Feb. 20, 2014

(86) PCT No.: PCT/EP2014/053304

§ 371 (c)(1),
(2) Date: Oct. 6, 2015

(87) PCT Pub. No.: WO2014/166664

PCT Pub. Date: Oct. 16, 2014

(65) Prior Publication Data

US 2016/0067718 A1 Mar. 10, 2016

(30) Foreign Application Priority Data

Apr. 8, 2013 (EP) ..... 13162746

(51) Int. Cl.
*B04B 1/20* (2006.01)

(52) U.S. Cl.
CPC ..... *B04B 1/20* (2013.01); *B04B 2001/2075* (2013.01); *B04B 2001/2083* (2013.01)

(58) Field of Classification Search
CPC ..... B04B 1/20; B04B 11/00; B04B 11/02; B04B 2001/2083; B04B 2001/2075; B04B 7/08

(Continued)

(56) References Cited

U.S. PATENT DOCUMENTS 4,334,647 A * 6/1982 Taylor ..... B04B 1/20 494/37
7,022,061 B2 * 4/2006 Leung ..... B04B 1/20 494/56

(Continued)

FOREIGN PATENT DOCUMENTS

DE 102010061563 A1 * 6/2012 ..... B04B 1/20
DE 102014108722 A2 * 11/2015 ..... B04B 1/20

(Continued)

OTHER PUBLICATIONS

International Search Report. dated Apr. 2014.

*Primary Examiner* — Charles Cooley
(74) *Attorney, Agent, or Firm* — Gerald E. Hespos; Michael J. Porco; Matthew T. Hespos

(57) ABSTRACT

A solid-bowl screw centrifuge has a centrifuge drum that can rotate about a longitudinal axis during operation. The centrifuge drum has a front wall with at least one discharge opening for discharging clarified product from the centrifuge drum. A weir edge is formed at the discharge opening radially toward the outside. An energy recovery device is provided for recovering energy from the clarified product that is being discharged. The energy recovery device defines a discharge pipe through which the clarified product passes as the clarified product flows out. The energy recovery device is situated on the outside of the front wall and in front of the discharge opening that has the weir edge.

10 Claims, 8 Drawing Sheets

(58) Field of Classification Search
USPC ..... 494/53, 54, 56, 57; 210/380.1, 380.3
See application file for complete search history.

(56) References Cited

U.S. PATENT DOCUMENTS

| | | | | |
|---|---|---|---|---|
| 9,993,831 | B2 * | 6/2018 | Pasol | B04B 1/20 |
| 10,105,715 | B2 * | 10/2018 | Schlarb | B04B 1/20 |
| 10,105,716 | B2 * | 10/2018 | Vielhuber | B04B 1/20 |
| 2004/0072667 | A1 * | 4/2004 | Leung | B04B 1/20<br>494/56 |
| 2004/0072668 | A1 * | 4/2004 | Leung | B04B 1/20<br>494/56 |
| 2014/0235423 | A1 * | 8/2014 | Pasol | B04B 1/20<br>494/56 |
| 2015/0217303 | A1 * | 8/2015 | Bauer | B04B 1/2016<br>494/4 |
| 2015/0360240 | A1 * | 12/2015 | Vielhuber | B04B 1/20<br>494/24 |
| 2016/0067718 | A1 * | 3/2016 | Schlarb | B04B 1/20<br>494/50 |

FOREIGN PATENT DOCUMENTS

| | | | | |
|---|---|---|---|---|
| EP | 2 551 021 | | 1/2013 | |
| EP | 2551021 | A1 * | 1/2013 | B04B 1/20 |
| JP | 11197547 | A * | 7/1999 | |
| WO | 2012/013624 | | 2/2012 | |
| WO | 2012/062337 | | 5/2012 | |
| WO | WO-2012089492 | A1 * | 7/2012 | B04B 1/20 |
| WO | WO-2013017223 | A1 * | 2/2013 | B04B 1/20 |

* cited by examiner

SOLID-WALL SCROLL CENTRIFUGE WITH FRONT WALL WITH DISCHARGE OPENING HAVING A WEIR EDGE AND AN ENERGY RECOVERY DEVICE DEFINING A DISCHARGE PIPE ON THE OUTSIDE OF THE FRONT WALL AND IN FRONT OF THE DISCHARGE OPENING HAVING THE WEIR EDGE

BACKGROUND

1. Field of the Invention

The invention relates to a solid-bowl screw centrifuge with a centrifuge drum, which can be rotated about a longitudinal axis during operation, on whose front side are embodied at least one discharge opening for allowing clarified product to flow out of the centrifuge drum, a weir gate bordering the discharge opening toward the outside radially and an energy recovery device for recovering energy from the clarified product discharged. Furthermore, the invention also relates to one such energy recovery device for mounting on a front wall of a centrifuge drum.

2. Description of the Related Art

It is known in general that a plurality of discharge openings may be provided on the front wall of the centrifuge drum of a generic solid-bowl screw centrifuge, so that the clarified product can flow out through the opening by way of a respective weir gate. The weir edge forms the radially inner edge of a respective weir gate, which is mounted on the front wall of the centrifuge drum so that it is radially adjustable.

In order for the kinetic energy of the product discharged to be reusable for driving the rotational movement of the centrifuge drum, energy recovery devices are now provided on such weir edges. It is thus known that, among other things, deflecting devices may be provided on the front wall of a centrifuge drum, so that the flow of clarified product can be diverted in a tangential direction. The product, which is then emerging from the centrifuge drum, not axially but instead tangentially opposite the direction of rotation of the centrifuge drum, transmits a momentum to the centrifuge drum in the direction of rotation, driving the centrifuge drum in the direction of rotation accordingly. Such deflecting devices are known from WO 2012 013624 A2, for example.

The invention is based on the object of creating a solid-bowl screw centrifuge which has a particularly effective energy recovery device.

SUMMARY

This object is achieved according to the invention with a solid-bowl screw centrifuge having a centrifuge drum that can rotate about the longitudinal axis during operation, such that at least one discharge opening for discharge of clarified product out of the centrifuge drum is formed on its front edge, a weir edge bordering the discharge opening toward the outside radially and an energy recovery device for recovering energy from the clarified product discharged also being formed there. The energy recovery device is designed as a discharge pipe, which is located upstream from the discharge opening and through which the clarified product flows out.

This object is also achieved with an energy recovery device that has been adapted for direct mounting axially on the outside in front of the respective discharge opening and is designed as a discharge pipe through which clarified product is discharged.

In the solid-bowl screw centrifuge according to the invention, the discharge opening in the front wall of the centrifuge drum extends essentially transversely to the longitudinal axis of the centrifuge. The weir edge, which may be aligned at least slightly, advantageously obliquely to the longitudinal axis, is situated radially on the outside of the discharge opening. The energy recovery device according to the invention, which is designed as a pipe that is closed over essentially its entire circumference, is situated on the outside directly axially in front of the discharge opening, essentially at the height and/or the radius of the weir edge. Such a pipe thus forms a discharge conduit, which is closed over its entire circumference on the outside axially, in front of the discharge opening. On the outside radially with respect to the longitudinal axis, this discharge pipe acts like a discharge channel and/or a discharge trough and at the same time is closed on the inside radially with respect to the longitudinal axis.

The approach according to the invention is based on the finding that the energy recovery effect of energy recovery devices of the aforementioned type is based in particular on this energy recovery device being closed on the inside radially. With this design, the product discharged through the energy recovery device is protected from external aerodynamic influences within the energy recovery device. Otherwise the air on the outside of the centrifuge drum, which is rotating at a high speed, will have a substantial influence on the product discharged, so that it loses a portion of its energy content due to friction with this air. This energy loss is prevented with the approach according to the invention, so that more energy can be recovered from the product discharged out of the device. With the approach according to the invention, the product discharged can be deflected from the axial direction essentially into the tangential direction in a particularly homogeneous and targeted manner. At the same time, energy losses occurring due to the diversion of the product discharged in the radial direction can be prevented. When using the discharge pipe according to the invention, the product discharged is held largely at the radius of the respective weir edge during the deflection, the discharge pipe being arranged on the outside axially in front of the discharge opening, so that even minor changes in the radius of the flow path may be advantageous, as will be explained below.

In the case of such a solid-bowl screw centrifuge, the centrifuge drum may advantageously be equipped so that it can rotate in two opposing directions. With the discharge pipe, the clarified product discharged is preferably deflected in the direction opposite the respective direction of rotation of the centrifuge drum. The energy recovery device according to the invention may also be designed with two active surfaces as the discharge pipe, one active surface of which manifests an effect in the first direction of rotation and the second direction of rotation manifests its effect in the second direction of rotation.

In the case of the solid-bowl screw centrifuge according to the invention, the discharge pipe is advantageously designed with at least one section having an essentially straight flow path, which is set at an inclination to the longitudinal axis of the centrifuge drum at an angle between 45° and 85°, preferably between 55° and 65°. The discharge pipe according to the invention also preferably has at least one section with an essentially straight flow path, which is set at an inclination radially toward the inside by an angle of 4° to 28°, preferably 8° to the tangential direction at the discharge opening. The bottom surface of such a section is especially advantageously designed to be flat for at least a portion and/or to be largely flat. Such a bottom surface can be produced especially favorably in terms of the manufacturing technology. In addition, the product discharged thereon experiences a uniform acceleration over a longer distance, so it is comparatively easy to reconstruct technically by modeling. The acceleration leads to an increased conversion of the centrifugal momentum into a kinetic momentum directed tangentially. As a particularly large component of the centrifugal energy, it is converted into a tangentially directed drive energy. The planar section of the bottom surface is especially preferably inclined radially inward by an angle of 4° to 28°, preferably 8° to the tangential direction. Such an alignment of the deflected product stream causes deceleration of the outgoing product, which is predefined in a targeted manner in comparison with a purely tangential flow and this leads to a precisely predetermined stagnation effect. This stagnation leads to an increase in the potential energy of the product discharged and thus an improved subsequent conversion into tangential kinetic energy.

Furthermore, the discharge pipe according to the invention preferably has a discharge mouth with a flow path and/or a direction of flow, which is set obliquely at an angle between 70° and 90°, preferably between 77° and 83° with respect to the longitudinal axis of the centrifuge drum. With such a direction of flow, the product discharged is deflected from axially at first to essentially tangentially, i.e., transversely to the former. Deflection to less than 90° with respect to the longitudinal axis entails the advantage that the product exiting the discharge mouth is not directed as sharply against the front wall of the centrifuge drum and therefore the friction losses are lower.

The approach according to the invention also advantageously provides a solid-bowl screw centrifuge in which the discharge pipe is designed with a flow cross section of a constant size in the direction of flow of the clarified product discharged. Alternatively, the discharge pipe is designed with a diminishing flow cross section, in particular tapering conically in the direction of flow of the clarified product discharged. A non-tapering flow shape reduces the risk of blockage of the discharge pipe during operation of the respective solid-bowl screw centrifuge. A tapering pipe shape creates an additional stagnation effect, which results in improved energy recovery. With the solid-bowl screw centrifuge according to the invention, the discharge pipe is also preferably designed with a round cross section, in particular a circular or elliptical cross section. Alternatively, the discharge pipe is designed with a rectangular cross section, in particular a square cross section. The two cross-sectional shapes mentioned above lead to energy recovery devices that are particularly inexpensive to manufacture. Furthermore, these cross sections are especially suitable for allowing the product discharged to flow out in a predetermined manner. A rectangular cross section also has the advantage that the product discharged emerges at the respective discharge mouth at a predefined radius on a wide plane.

Finally, with the solid-bowl screw centrifuge according to the invention, the discharge pipe is preferably designed with an adapted aerodynamic exterior wall shape. The flow resistance of the energy recovery device and thus the respective energy loss can be reduced with this exterior wall shape. An aerodynamically adapted exterior wall shape is understood here to be a shape which offers the least possible flow resistance for oncoming air. Such a shape is rounded with no edges and is provided with a smooth surface with very little roughness.

An exemplary embodiment of the approach according to the invention is described in greater detail below on the basis of the accompanying schematic drawings.

DETAILED DESCRIPTION

Figure 1:
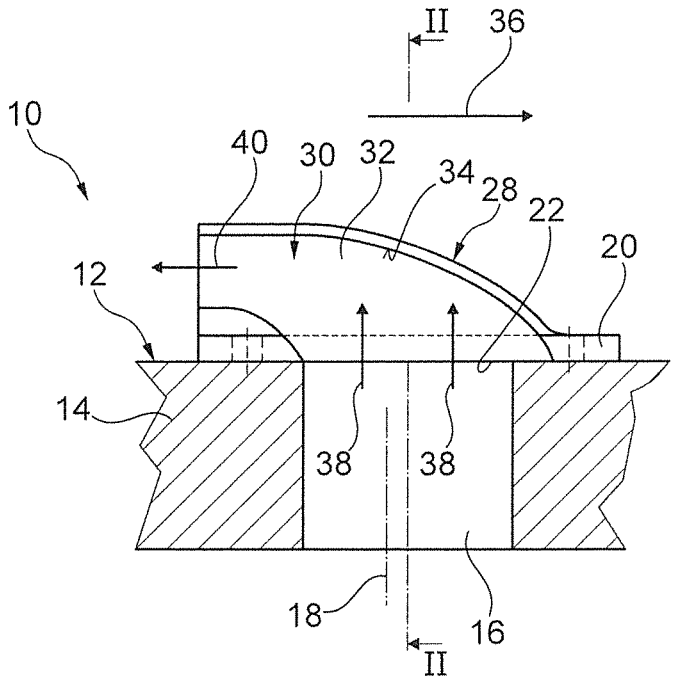
Fig. 1 Prior Art
FIG. 1 shows a longitudinal section through a centrifuge drum with a weir gate and an energy recovery device of a solid-bowl screw centrifuge according to the prior art.
Figure 2:
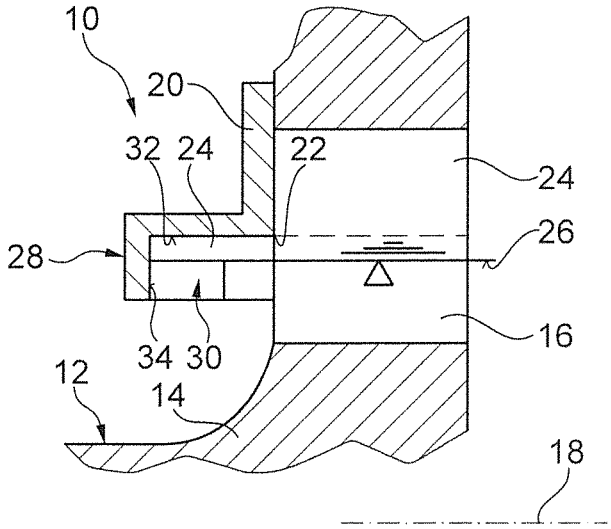
Fig. 2 Prior Art
FIG. 2 shows the longitudinal section II-II in FIG. 1.

FIGS. 1 and 2 show the centrifuge drum 12 of a solid-bowl screw centrifuge 10 with its front end, i.e., front wall 14. On the front wall 14 can be seen one of several discharge openings 16 passing axially through the front wall 14 in the direction of a longitudinal axis 18 of the centrifuge drum 12. On the outside in front of the discharge opening 16, a weir gate 20 is in a stationary mount on the front wall 14, where it is adjustable. The weir gate 20 protrudes to just in front of the discharge opening 16, so that it covers the latter on the outside on its radially outer region. The weir gate 20 has a weir edge 22 on its radially inward facing border. According to the prior art, such a weir edge 22 extends along the front wall 14 and thus across the longitudinal axis 18. The weir edge 22 retains clarified product 24 in the centrifuge drum 12, so that during operation of the solid-bowl screw centrifuge 10, this clarified product 24 collects there with a pond depth 26 and then flows off over the weir edge 22 mostly continuously thereafter.

An energy recovery device 28 according to the prior art is situated on the outside axially on the weir gate 20 behind, i.e., downstream from the weir edge 22 in the direction of flow of the clarified product 24. This energy recovery device 28 is designed as a discharge trough, i.e., a discharge channel 30, which has a flat bottom surface 32 extending tangentially at the height of the weir edge 22. A deflecting surface 34, which, as part of the discharge channel 30 perpendicular to the bottom surface 32, extends in an arc shape in front of the region of the discharge opening 16 that is open as seen in the longitudinal direction according to the prior art.

The deflecting surface 34 deflects the clarified product 24 that flows down axially through the discharge opening 16 on the inside radially below the weir edge 22 in a direction of inflow 38 is deflected in a direction tangential to a discharge direction 40. Meanwhile the centrifugal drum 12 rotates in one direction of rotation 36, while the clarified product 24 is deflected by the deflecting surface 34, so that it emerges tangentially from the energy recovery device 28 in the opposite direction from this direction of rotation 36. On its exit, the clarified product 24 "is repelled by" the centrifuge drum 12, thereby transferring a portion of its momentum to the centrifuge drum 12 and contributes toward energy recovery on the centrifuge drum 12. This "repulsion" is mitigated by the internal fluid friction in the clarified product 24 and by the fact that the centrifuge drum 12 continues to rotate in the direction of rotation 36. The centrifuge drum 12 therefore partially evades the repulsion.

Figure 4:
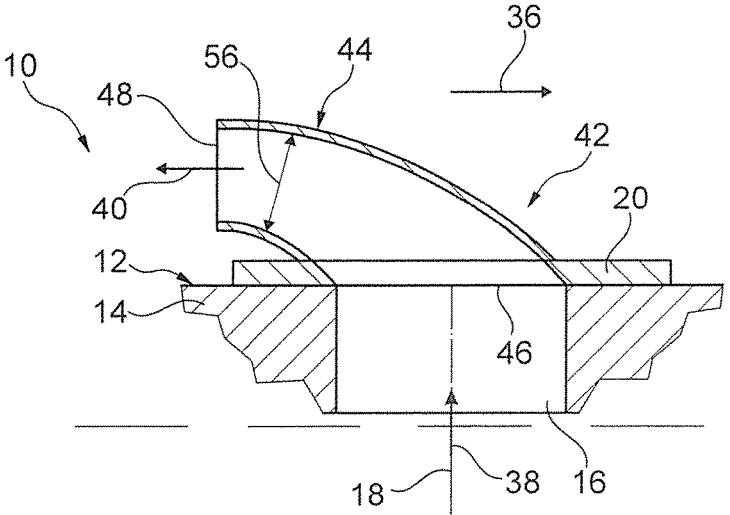
FIG. 4 shows the longitudinal section IV-IV according to FIG. 3.
Figure 3:
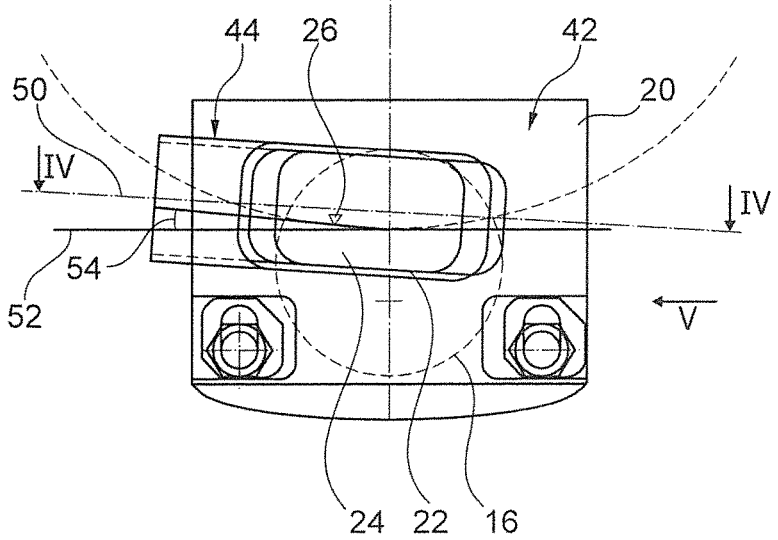
FIG. 3 shows a side view of a centrifuge drum with a weir gate and an energy recovery device of a first exemplary embodiment of a solid-bowl screw centrifuge according to the invention.
Figure 5:
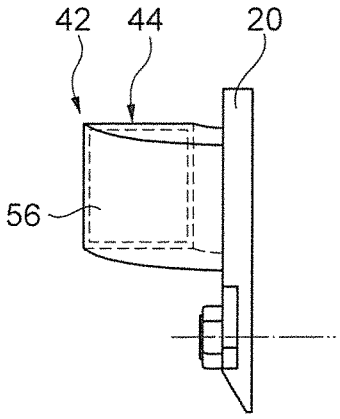
FIG. 5 show the view V according to FIG. 4.

FIGS. 3 through 5 show a first exemplary embodiment of a solid-bowl screw centrifuge 10 with its centrifuge drum 12, on which an energy recovery device 42 according to the invention is arranged. The energy recovery device 42 also has a weir gate 20 of the traditional type in front of the respective discharge opening 16. On the outside axially there is a discharge pipe 44 on the weir gate 20, through which discharge pipe 44 flows the clarified product discharged through the discharge opening 16.

With regard to its cross section, the discharge pipe 44 is situated directly in front of the region of the otherwise open discharge opening 16, so that the opening is completely covered by the discharge pipe 44 on the outside. Therefore, no air flow can act from the outside during the passage of the clarified product past the discharge opening 16 and therefore this yields a particularly uniform flow, in particular a strictly laminar flow, with the corresponding purity of the clarified product discharged. The discharge pipe 44 is situated at the height and/or radius of the weir edge 2, so that the product thereby being discharged undergoes practically no change in position in the radial direction and there are no energy losses accordingly.

On its circumference, the discharge pipe 44 is completely closed and forms a tubular line with an inflow mouth 46 in front of the discharge opening 16 and a discharge mouth 48 on its other exterior end. The outer part of this pipe on the outside radially with respect to the longitudinal axis 18 acts like a discharge trough, i.e., a discharge channel, and at the same time is closed on the inside radially with respect to the longitudinal axis 18 of the centrifuge drum 12. Therefore, the product discharged through the energy recovery device 42 is also protected against external aerodynamic influences on the inside of the discharge pipe 44. The product is deflected out of the axial direction homogeneously, without turbulence and in a targeted manner, i.e., the incoming flow direction 38 essentially into the tangential direction, i.e., the discharge direction 40.

With the discharge pipe 44, the product discharged is largely held at the radius of the weir edge 22 during the deflection process, wherein the discharge pipe 44 has a straight flow path 50, as seen in a side view (FIG. 3), which is set at an inclination radially toward the inside by an angle 54 of 6° to 8° to the tangential direction 52 on the discharge opening 16. A respective bottom surface of the discharge pipe 44 is designed to be planar and/or largely planar and also set at an angle 54 of 6° to 8° at an inclination to the tangential direction 52. At the same time, the discharge pipe 44 according to FIGS. 3 through 5 has a rectangular flow cross section 56, which is designed to taper starting from the inflow mouth 46 and going steadily to the discharge mouth 48. With such a taper, the product discharged is subject to additional stagnation and is bundled into a stream.

Figure 7:
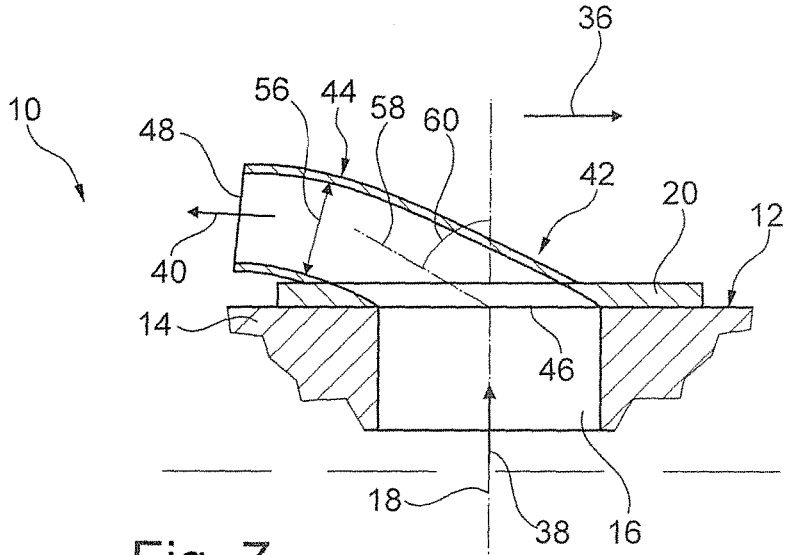
FIG. 7 shows the longitudinal section VII-VII according to FIG. 6.
Figure 8:
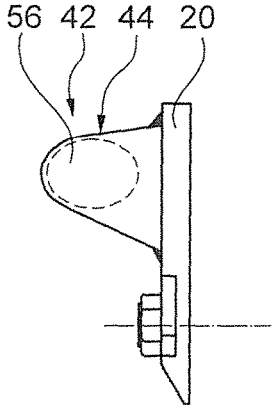
FIG. 8 shows the view VIII according to FIG. 7.
Figure 6:
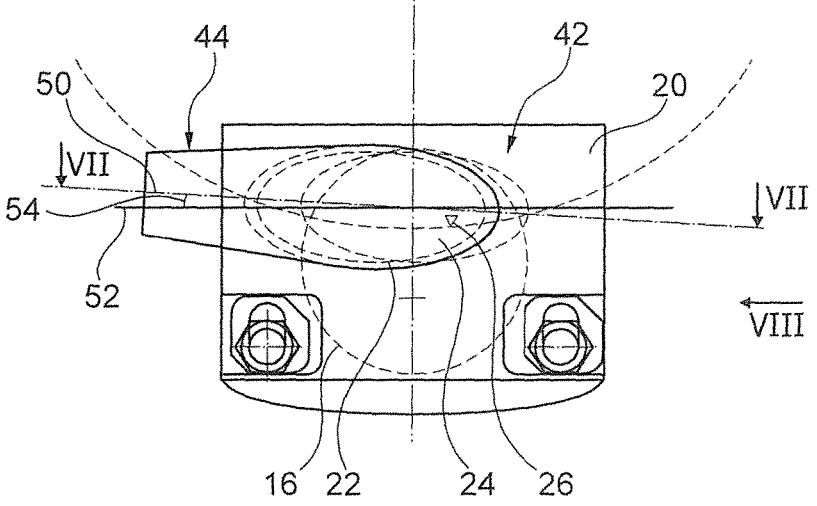
FIG. 6 shows a side view of centrifuge drum with a weir gate and an energy recovery device of a second exemplary embodiment of a solid-bowl screw centrifuge according to the invention.

In the exemplary embodiment of an energy recovery device 42 according to FIGS. 6 to 8, the discharge pipe 44 there is designed with an oval flow cross section 56. Such a flow cross section 56 also tapers over the flow path of the product discharged through the discharge pipe 44. The discharge pipe 44 has a section with an essentially straight flow path 58, as seen in the longitudinal section (FIG. 7) downstream from the inflow mouth 46, set at an angle 60 between 55° and 65° to the longitudinal axis 18 of the centrifugal drum. On the whole, this design yields a droplet shape (see FIG. 6) for the discharge pipe 44, which is particularly advantageous aerodynamically.

Figure 10:
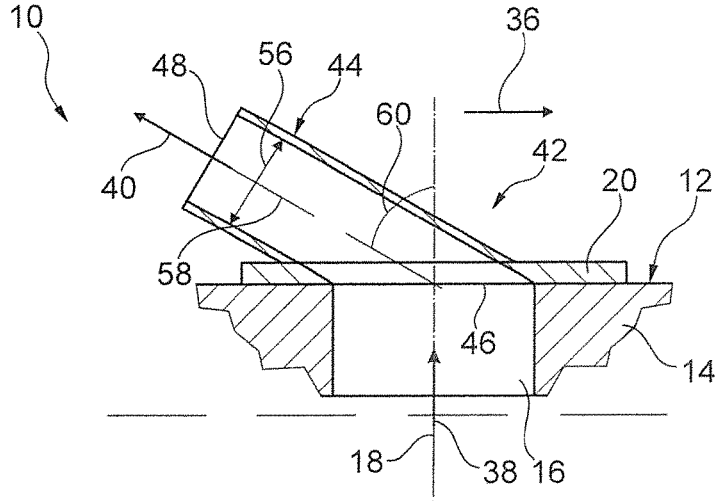
FIG. 10 shows the longitudinal section X-X according to FIG. 9.
Figure 11:
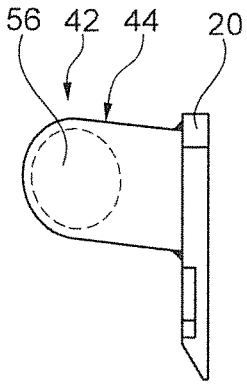
FIG. 11 shows the view XI according to FIG. 10.
Figure 9:
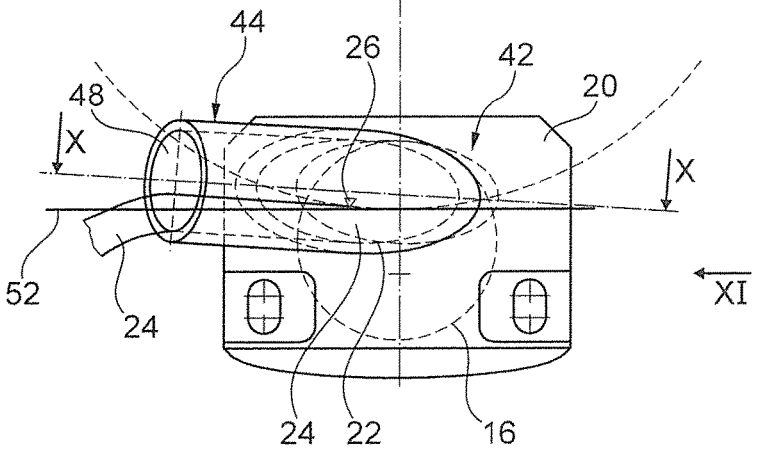
FIG. 9 shows a side view of a centrifuge drum with a weir gate and an energy recovery device of a third exemplary embodiment of a solid-bowl screw centrifuge according to the invention.

FIGS. 9 through 11 show an exemplary embodiment of an energy recovery device 42, in which the discharge pipe 44 is designed with an essentially circular flow cross section 56. At the same time, the flow path 58, which is essentially straight in the longitudinal section, extends over the total length of the discharge pipe 44, so that the pipe is designed as a straight cylindrical pipe on the whole. Such a solution can be manufactured very inexpensively.

Figure 13:
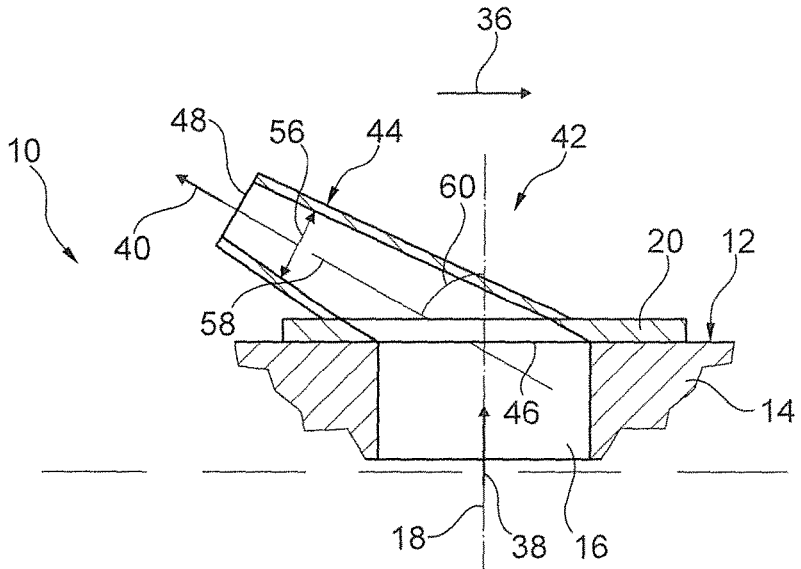
FIG. 13 shows the longitudinal section XIII-XIII according to FIG. 12.
Figure 14:
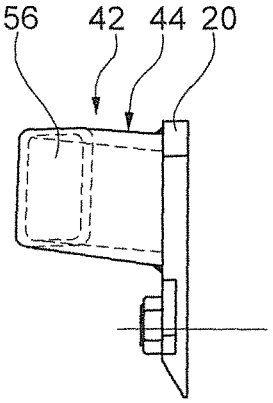
FIG. 14 shows the view XIV according to FIG. 13.
Figure 12:
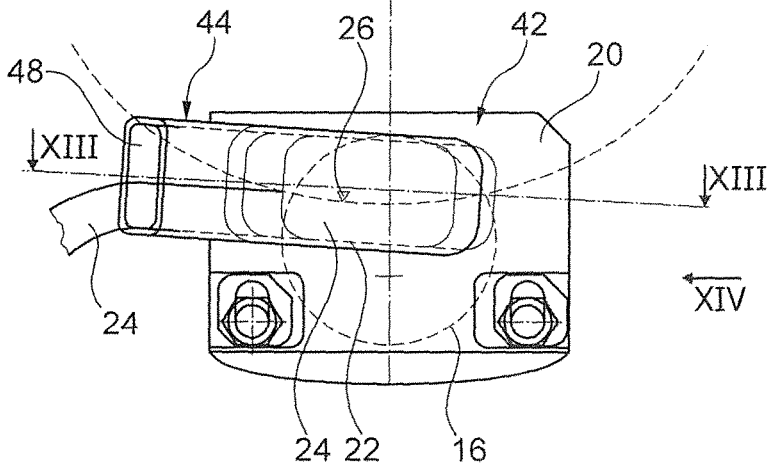
FIG. 12 shows a side view of a centrifuge drum with a weir gate and an energy recovery device of a fourth exemplary embodiment of a solid-bowl screw centrifuge according to the invention.

FIGS. 12 through 14 show an exemplary embodiment of an energy recovery device 42, in which the respective discharge pipe 44 is designed as a conical pipe set at an inclination upstream from the discharge opening 16. The pipe is set at an inclination to the longitudinal axis 18 at an angle 60 of 60° and is conical over its entire length and is designed to be rectangular in the flow cross section 56. The height of the flow cross section 56 is kept constant over the length of the discharge pipe 44.

Figure 16:
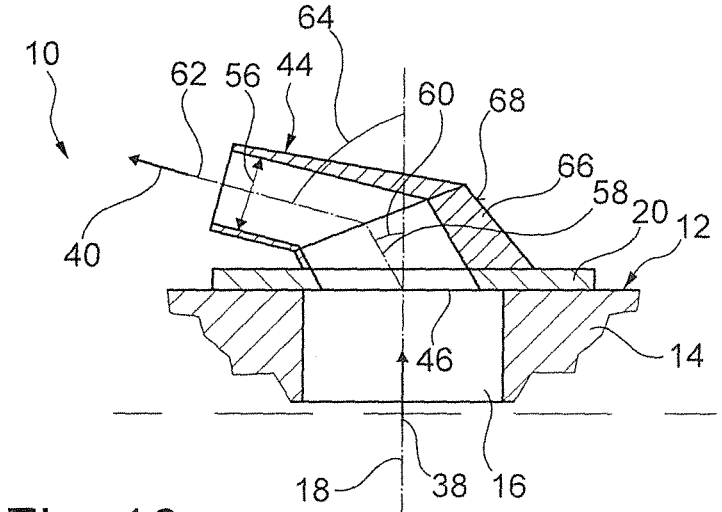
FIG. 16 shows the longitudinal section XVI-XVI according to FIG. 15.
Figure 17:
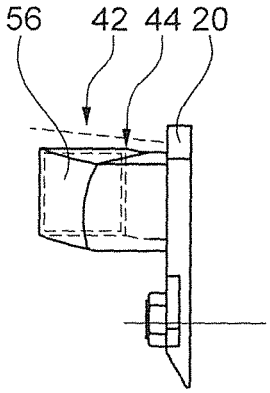
FIG. 17 shows the view XVII according to FIG. 16.
Figure 15:
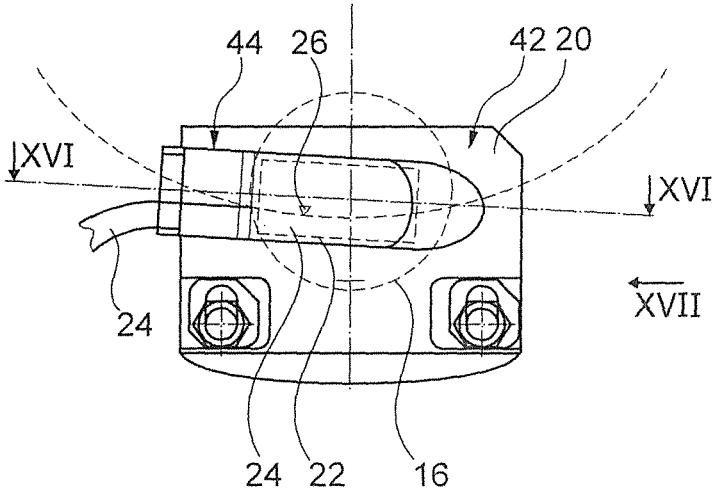
FIG. 15 shows a side view of a centrifuge drum with a weir gate and an energy recovery device of a fifth exemplary embodiment of a solid-bowl screw centrifuge according to the invention.

The energy recovery device 42 shown in FIGS. 15 through 17 is designed with a bent discharge pipe 44, which has a first section with an angle 60 of 30° to the longitudinal axis 18 and a second section with an angle 64 of 75° to the longitudinal axis 18. This second section forms one direction of flow 62 at the respective discharge mouth 48, so that the flow path, i.e., the direction of flow 62 there, is also set at an inclination at an angle 64 of 75° with respect to the longitudinal axis 18 of the centrifuge drum 12. With such a direction of flow 62, the product discharged is deflected fundamentally across the longitudinal axis 18, but at the same time, is not deflected toward the front wall 14 so strongly that it results in energy losses there due to fluid friction during the discharge.

Finally, with the exemplary embodiments according to FIGS. 15 to 21, the discharge pipe 44 there is designed on its exterior wall 66 facing the direction of rotation 36 with an adapted aerodynamic exterior wall shape 68. The exterior wall shape 68 here is such that the wall thickness, starting from the inflow mouth 46, decreases steadily in the direction of flow of the product discharged, as far as the discharge mouth 48. The outside of the exterior wall 66 is thus flatter with respect to the incoming air in rotation of the centrifuge drum 12 and therefore is designed to be smaller with respect to the flow resistance. At the same time, this form of the wall thickness is advantageous with respect to a great rigidity of the discharge pipe 44 in relation to its weight.

Figure 18:
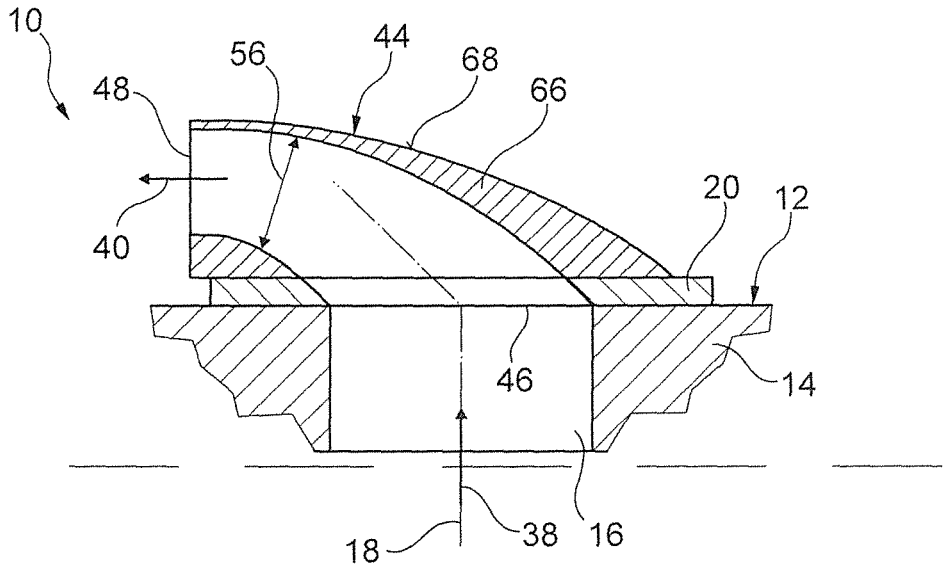
FIG. 18 shows the longitudinal section XVIII-XVIII according to FIG. 19 of a centrifuge drum with a weir gate and an energy recovery device of a sixth exemplary embodiment of a solid-bowl screw centrifuge according to the invention.
Figure 19:
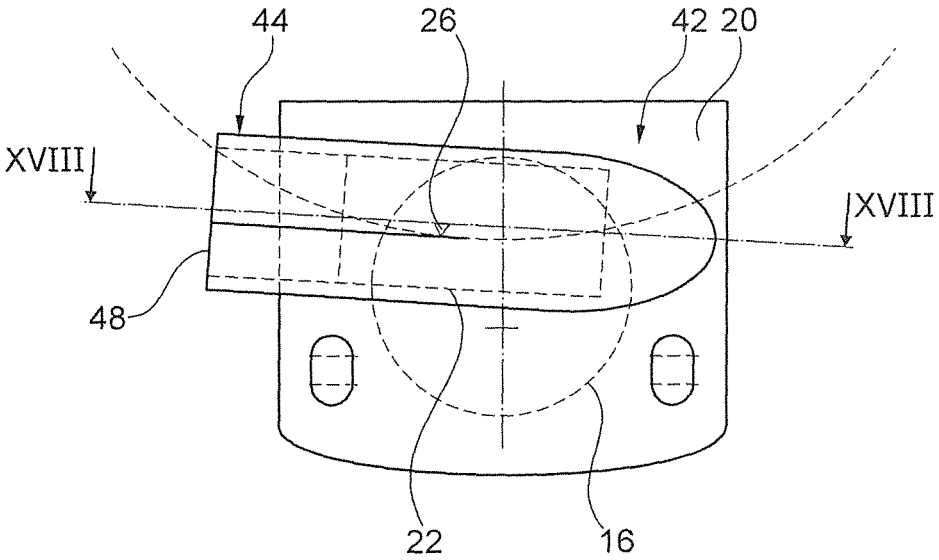
FIG. 19 shows a side view of a centrifuge drum according to FIG. 18.
Figure 20:
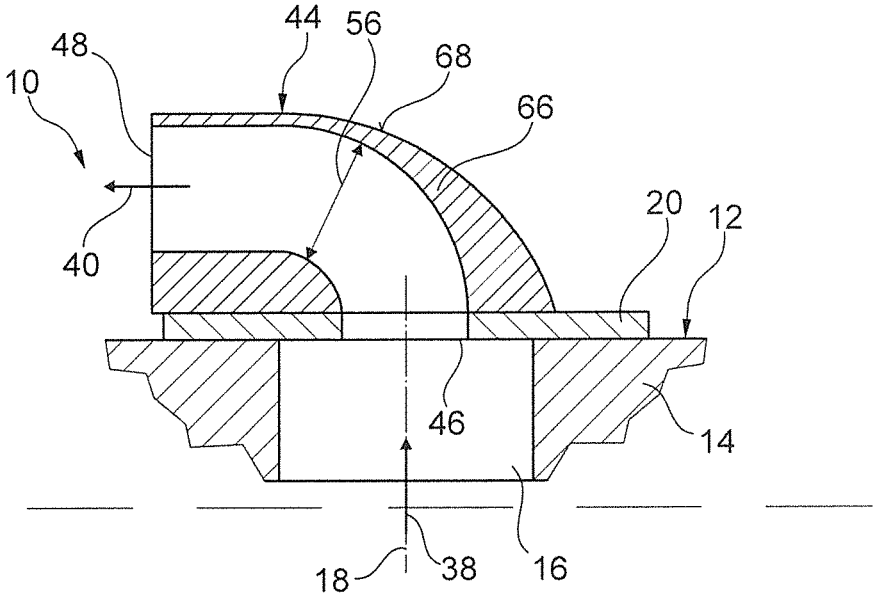
FIG. 20 shows the longitudinal section XX-XX according to FIG. 21 of a centrifuge drum with a weir gate and an energy recovery device of a seventh exemplary embodiment of a solid-bowl screw centrifuge according to the invention.
Figure 21:
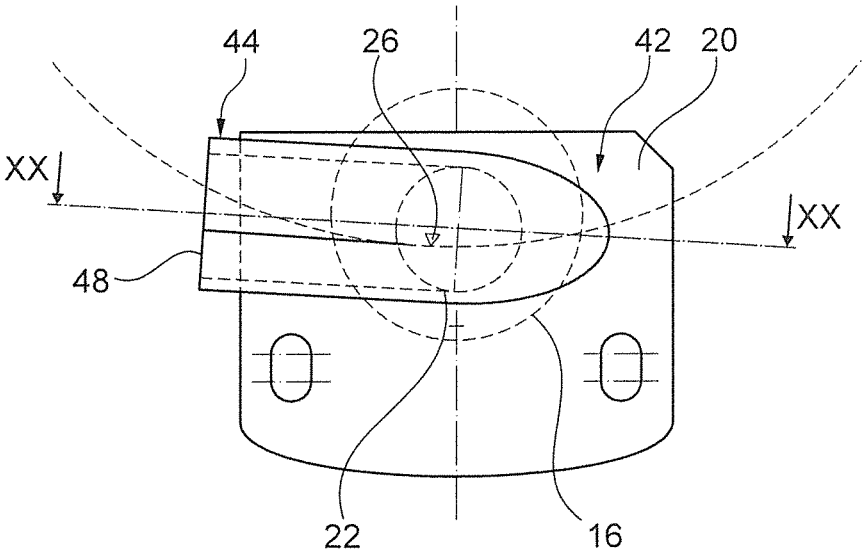
FIG. 21 shows a side view of a centrifuge drum according to FIG. 20.

In the exemplary embodiment according to FIGS. 18 and 19, this design of a discharge pipe 44 is combined with a continuously tapering inner flow cross section 56 and a continuous arc shape like that in FIGS. 3 to 5. The exemplary embodiment according to FIGS. 20 and 21 also shows a continuous arc shape of the discharge pipe 44, wherein its flow cross section 56 is kept the same size over the entire flow length. With such a flow cross section profile, blockage of the discharge pipe 44 with product being discharged is additionally prevented.

In conclusion, it should be pointed out that all the features mentioned in the patent application documents and in particular in the dependent claims, which should have a formal reference back to one or more specific claims, even individually or in any combination, are entitled to independent protection either individually or in any combination.

LIST OF REFERENCE NUMERALS

10 solid-bowl screw centrifuge
12 centrifuge drum
14 front wall
16 discharge opening
18 longitudinal axis of the centrifuge drum
20 weir gate
22 weir edge
24 clarified product
26 pond depth
28 energy recovery device according to the prior art
30 discharge channel according to the prior art
32 bottom surface according to the prior art
34 deflecting surface according to the prior art
36 direction of rotation
38 inflow direction of the clarified product (axially)
40 discharge direction of the clarified product (tangentially)
42 energy recovery device according to the invention
44 discharge pipe
46 inflow mouth
48 discharge mouth
50 straight flow path in a side view
52 tangential direction
54 angle between tangential direction and flat flow path in a side view
56 flow cross section
58 straight flow path in a longitudinal section
60 angle between longitudinal axis and flat flow path in the longitudinal section
62 direction of flow at the discharge mouth
64 angle between the longitudinal axis and the direction of flow at the discharge mouth
66 exterior wall of the discharge pipe facing in the direction of rotation
68 aerodynamic exterior wall shape

The invention claimed is:

1. A solid-bowl screw centrifuge (10) having a centrifuge drum (12) that can rotate about a longitudinal axis (18) during operation, the centrifuge drum (12) having a front wall (14) with at least one discharge opening (16) for discharge of clarified product (24) out of the centrifuge drum (12) a weir gate (20) defining a plate attached to the front wall (14) and having a weir edge (22) delimiting the discharge opening (16) toward the outside radially, and an energy recovery device (28; 42) for recovering energy from the clarified discharged product (24), the energy recovery device (42) defining a discharge pipe (44) disposed outside axially on the weir gate (20) and through which the clarified product (24) passes as the clarified product (24) flows out, the discharge pipe (44) of the energy recovery device (42) being situated on the outside of the front wall (14) and directly in front of the discharge opening (16) that has the weir edge (22) such that the discharge pipe (44) extends circumferentially completely across the opening and at a position spaced axially outward from the opening.

2. The solid-bowl screw centrifuge according to claim 1, wherein, with the discharge pipe (44), the clarified discharged product (24) is deflected opposite a respective direction of rotation (36) of the centrifuge drum (12).

3. The solid-bowl screw centrifuge according to claim 1, wherein the discharge pipe (44) has at least one section having an essentially straight flow path (50) that is set at an inclination by an angle (54) of 4° to 28° radially inward to a tangential direction (52) at the discharge opening (16).

4. The solid-bowl screw centrifuge according to claim 1, wherein the discharge pipe (44) has at least one section with an essentially straight flow path (58), in which the longitudinal axis (18) of the centrifuge drum (12) is set at an inclination at an angle (60) between 45° and 85° with respect to the straight flow path (58).

5. The solid-bowl screw centrifuge according to claim 1, wherein the discharge pipe (44) has a discharge mouth (48) with a direction of flow (62) that is set at an inclination with respect to the longitudinal axis (18) of the centrifuge drum (12) at an angle (64) between 70° and 90°.

6. The solid-bowl screw centrifuge according to claim 1, wherein the discharge pipe (44) is designed with a flow cross section (56) of a constant size in the direction of flow of the clarified discharged product (24).

7. The solid-bowl screw centrifuge according to claim 1, wherein the discharge pipe (44) is designed with a reduced flow cross section (56) in the direction of flow of the clarified discharged product (24).

8. The solid-bowl screw centrifuge according to claim 1, wherein the discharge pipe (44) is designed with a round flow cross section (56).

9. The solid-bowl screw centrifuge according to claim 1, wherein the discharge pipe (44) is designed with a rectangular flow cross section (56).

10. The solid-bowl screw centrifuge according to claim 1, wherein the discharge pipe (44) has an exterior wall (66) facing in a direction of rotation (36).

* * * * *